US006026669A

United States Patent [19]

Ginzburg

[11] Patent Number: 6,026,669

[45] Date of Patent: Feb. 22, 2000

[54] DISCRETE AND COILED PLATE PRODUCTION

[75] Inventor: Vladimir B. Ginzburg, Pittsburgh, Pa.

[73] Assignees: Danieli United, Cranberry Twp.; International Rolling Mill Consultants, Inc., Pittsburgh, both of Pa.

[21] Appl. No.: 09/256,433

[22] Filed: Feb. 23, 1999

[51] Int. Cl.[7] ..... B21B 41/06

[52] U.S. Cl. ..... 72/229; 72/365.2

[58] Field of Search ..... 72/229, 365.2, 72/366.2, 205, 203, 231, 226, 201, 200, 202

[56] References Cited

U.S. PATENT DOCUMENTS

| | | | |
|---|---|---|---|
| 603,102 | 4/1898 | Edwards . | |
| 1,932,750 | 10/1933 | Rendleman | 80/37 |
| 3,729,972 | 5/1973 | Kocks | 72/228 |
| 3,774,433 | 11/1973 | Pauels | 72/203 |
| 5,276,952 | 1/1994 | Thomas et al. | 29/527 |
| 5,414,923 | 5/1995 | Thomas et al. | 29/527.7 |
| 5,423,200 | 6/1995 | Shore | 72/201 |
| 5,467,519 | 11/1995 | Tippins et al. | 29/527.7 |
| 5,499,523 | 3/1996 | Ginzburg | 72/229 |
| 5,533,248 | 7/1996 | Tippins et al. | 72/229 |
| 5,544,408 | 8/1996 | Tippins et al. | 72/229 |
| 5,706,688 | 1/1998 | Dorricott | 72/203 |

FOREIGN PATENT DOCUMENTS 1272261 11/1968 Germany .

*Primary Examiner*—Joseph J. Hail, III
*Assistant Examiner*—Rodney Butler
*Attorney, Agent, or Firm*—Armstrong, Westerman, Hattori, McLeland & Naughton

[57] ABSTRACT

The present invention is a method and apparatus for the production of both discrete metal plate and coiled metal plate products. In a mill having at least two in-line reversing plate mill stands, a reheated slab can be rolled on a first reversing plate mill in several reversing flat passes. The rolled product can then be sent to a second in-line reversing plate mill for additional rolling followed by winding in a downstream coiler. In the present invention, while the rolled product is sent to the second reversing plate mill, a virgin reheated slab can be introduced and rolled on the first reversing plate mill in several reversing flat passes. This product, subsequent to a slab which is rolled and sent to the second reversing plate mill, can be sent upstream along runout tables for further processing in finishing equipment. When the first reversing plate mill is again clear of rolled product, another virgin reheated slab can be introduced to the first mill and the above process can be repeated. By this method and apparatus, at least two reversing plate mill stands can be operated to produce both discrete metal plate product and coiled metal product.

14 Claims, 2 Drawing Sheets

DISCRETE AND COILED PLATE PRODUCTION

FIELD OF THE INVENTION

The present invention relates to the production of both discrete metal plate and coiled metal plate products.

BACKGROUND OF THE INVENTION

It is known to process metal products by rolling the material on continuous roughing and finishing mills in succession, subsequently cutting the material into lengths and conveying the lengths on a cooling bed, over which they are transported and then coiled or stacked and off-loaded. The production capacity of a mill or a process line is primarily determined by the speed of rolling and the rate at which following stock handling units are able to cope with the rolled stock; which stock handling units have to operate at the same rate as the process line.

A typical rolling mill, for example, comprises a series of sequential rolling stands designed to accept the initial slab or cast strand and to process it without interruption until the final end-product thickness is reached. It is essential that each downstream item of equipment has an operating capacity that is sufficient to handle the incoming material from upstream. This requirement admits of very little flexibility in the mill operation for any given end-product. The rate limiting or capacity limiting element of a rolling mill is the rate or capacity of the slowest or lightest piece of equipment. As a result of the sequential in-line material handling on prior art processing lines, the entire processing line can be no more efficient than the least inefficient member of the line.

OBJECTS OF THE INVENTION

It is the principal object of the invention to provide a method and apparatus for the production of both discrete metal plate and coiled metal plate products.

It is an object of the present invention to provide a method and apparatus that can produce both discrete metal plate and coiled metal plate products at substantially the same time.

It is another object of the present invention to provide a method and apparatus that utilizes two reversing plate mills which can be operated almost continuously.

It is still another object of the present invention to provide a method for the production of discrete plate and coiled plate products from the output of a first reversing plate mill, with the production of discrete plate and coiled plate products occurring in parallel.

It is yet another object of the present invention to provide a method for the production of discrete plate and coiled plate products wherein the production of one of the plate products requires additional finishing in a second reversing plate mill.

It is a further object of the present invention to provide an apparatus for the production of both discrete plate and coiled plate products in parallel in a single in-line apparatus.

It is still a further object of the present invention to provide a method and apparatus for the production of discrete plate and coiled plate metal products that are of improved efficiency.

Other objects, features and advantages of the present invention will become apparent from the following detailed description taken in conjunction with the accompanying drawings.

SUMMARY OF THE INVENTION

The present invention is a method and apparatus for the production of both discrete metal plate and coiled metal plate products. Significant improvements in efficiency can be realized by locating finishing processes upstream from a first reversing plate mill in a multiple mill plant. In a mill having at least two in-line reversing plate mill stands, a reheated slab can be rolled on a first reversing plate mill in several reversing flat passes. The rolled product can then be sent to a second in-line reversing plate mill for additional rolling followed by winding in a downstream coiler. In the present invention, while the rolled product is sent to the second reversing plate mill, a virgin reheated slab can be introduced and rolled on the first reversing plate mill in several reversing flat passes. This product, subsequent to a slab which is rolled and sent to the second reversing plate mill, can be sent upstream along runout roller tables for further processing in finishing equipment. When the first reversing plate mill is again clear of rolled product, another virgin reheated slab can be introduced to the first mill and the above process can be repeated.

In this method and apparatus, at least two reversing plate mill stands may be operated substantially simultaneously. Instead of operating the entire process line in a series configuration, i.e. processing slabs in a single direction; the process line can be operated in a parallel configuration. In other words, a first reversing plate mill operating almost continuously can send product in one direction to second reversing plate mill or it can send product in the opposite direction to finishing equipment. Locating finishing equipment upstream from the first reversing plate mill reduces overall process line inefficiency, which was previously dependent on the typically slower rate of processing of the second reversing plate mill.

DETAILED DESCRIPTION OF THE INVENTION

Figure 1:
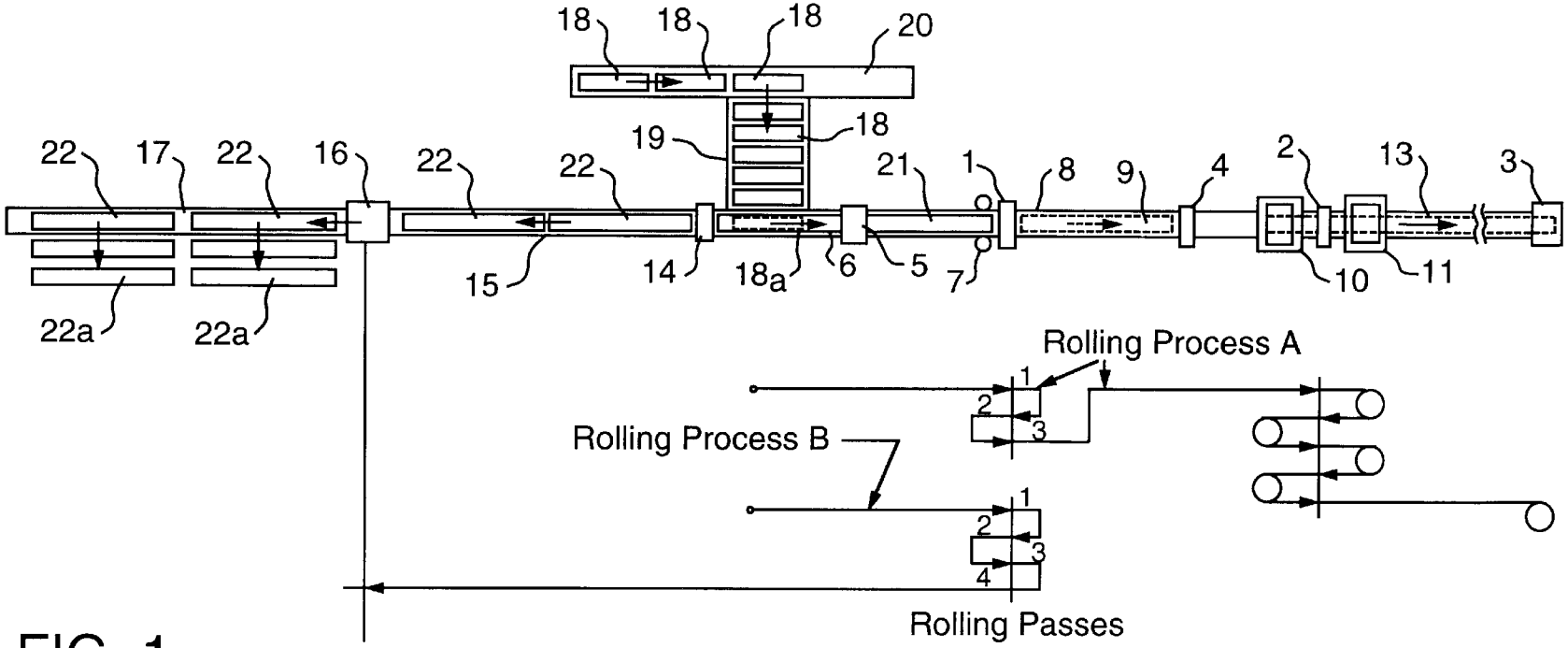
FIG. 1 is a schematic view of a mill for producing both discrete metal plate and coiled metal plate products, representing the production of coiled products by rolling process A and the production of discrete plate products by rolling process B.

The present invention relates to plate mills that have at least two reversing plate mill stands. In the current state of the plate mill art, the rolling process for metal product includes two rolling steps. The first step involves rolling a reheated slab on a first reversing plate mill, known as a roughing mill, usually having an edger apparatus, in several reversing flat passes without coiling. The effect of this first step is to roll a metal slab from about 4 to 10 inches in thickness down to a bar size of approximately 0.75 to 1.5 in. (inches) thick. During the second step, the bar is rolled in several reversing flat passes on a second reversing plate mill, known as a finishing mill, often equipped with coiling furnaces to provide heat conservation.

In the current state of the art, after rolling on the second reversing plate mill, the bar or product enters a runout roller table, for example, and then proceeds along one of the two following process routes. The first route involves winding the product on a coiler, like a downcoiler for example, located downstream the runout tables. The coiler winds the product so it can be removed from the line in coiled form.

The second alternate route involves processing the product through plate finishing equipment located downstream of the aforementioned coiler. The product will pass through the coiler without being wound and can enter finishing equipment further downstream. Plate finishing operations may include, cutting the plate into shorter plates by a shear, passing cut plates through a hot leveler, and transferring cut plates to cooling beds, for example. After cooling, the plates can be side trimmed to obtain a desired width and then stacked.

The inventor of the present invention realized, however, that significant improvements in efficiency can be achieved by locating finishing processes upstream from a first reversing plate mill in a multiple mill plant. The result is the present invention which is a method and apparatus for production of discrete metal plate while the production of coiled metal plate products also occurs. As an example, the apparatus of the present invention includes a first hot reversing plate mill stand (a roughing mill) followed by an in-line second hot reversing plate mill stand (a finishing mill). Discrete metal slabs arrive at the first hot reversing plate mill stand after being heated in a reheat furnace. Individual metal slabs are then rolled, according to a first rolling schedule, in the first hot reversing plate mill in order to obtain a product, called a transfer bar, having a thickness within a first specified range.

The transfer bar is then processed in the in-line second hot reversing plate mill. The transfer bar proceeds downstream toward the second in-line hot reversing plate mill which has coiling furnaces on its upstream and downstream sides. A shear apparatus may be located upstream the second in-line hot reversing plate mill to cut a single transfer bar to successive lengths. The transfer bar rolled in the second in-line reversing plate mill by several flat passes is sent further downstream to be wound in a coiler to form coiled metal plate.

While the transfer bar is being rolled in the second reversing plate mill, another individual slab heated in the reheat furnace is introduced to the first reversing plate mill. The individual slab is rolled according to a second rolling schedule, different from the first rolling schedule, to obtain a product, called a mother plate, having a thickness within a second specified range.

The mother plate is directed upstream, instead of downstream, from the first hot reversing plate mill along a series of transport tables, to a shearing device which divides the mother plate into at least two daughter plates and then transports the daughter plates to a hot leveler apparatus. The subsequent daughter plates are flattened by the hot leveler and chilled on runout roller tables following the hot leveler. The daughter plates are of a similar thickness to the mother plate. By design, the apparatus of the present invention includes both finishing equipment that can produce discrete metal products as well as a second reversing plate mill and a coiler to produce coiled products.

The method of the present invention provides for the production of discrete metal plate and coiled metal products from the output of the first reversing plate mill. The production occurs substantially in parallel with the discrete metal plate products being produced upstream of the coiled products. To achieve parallel production, metal slabs enter the first reversing plate mill and are rolled at the production rate of the first reversing plate mill, called the first rolling rate. The metal slabs are rolled into products called transfer bars, which are directed downstream from the first hot reversing plate mill to the second reversing plate mill.

Downstream from the first reversing plate mill, the transfer bar can be sheared into successive lengths and proceeds further downstream to the second in-line hot reversing plate mill. The sheared transfer bars are rolled in the second in-line reversing plate mill at the production rate of the second reversing plate mill, called the second rolling rate. The transfer bars can then be wound in either one of the coiling furnaces upstream or downstream of the second mill stand after being rolled in this second mill. The coiled product in the coiling furnace is then rewound on a downcoiler, downstream from the coiling furnaces.

After a transfer bar exits the first reversing plate mill, another metal slab enters the first reversing plate mill. The other metal slab is rolled according to a second rolling schedule into a product called a mother plate, which instead of proceeding downstream, is directed upstream after exiting the first hot reversing plate mill. The mother plate is transported upstream on transfer tables to a shear apparatus and a hot leveler. At the same time the transfer bar is being rolled or flat passed in the second in-line hot reversing plate mill, the mother plate proceeds upstream to be sheared into daughter plates and flattened by a hot leveler. The daughter plates then cool on a runout table and are collected as discrete metal plate products.

Virgin metal slabs enter the first hot reversing plate mill in sequence after the first hot reversing plate mill is clear of output. The first hot reversing plate mill is operated almost continuously creating output to be processed either upstream or downstream into discrete metal plate or coiled metal plate, respectively.

As previously described, in the apparatus of the present invention, at least one reversing plate mill may be operated while at least one other reversing plate mill is operating. Instead of operating a process line in a series configuration, i.e. processing slabs in a single direction; a process line can be operated in a parallel configuration. In other words, a first reversing plate mill operating almost continuously can send product in one direction to second reversing plate mill or it can send product in the opposite direction to finishing equipment. Because the second rolling rate described above is typically slower than the first rolling rate, the apparatus and method of the present invention is more efficient than prior art process lines operated in a single direction.

The preferred embodiment of the apparatus of the present invention is shown in FIG. 1 which includes a schematic line representation of two rolling processes, Rolling Process A and Rolling Process B. Rolling Process A, the rolling process for making coiled metal product, can occur during Rolling Process B, the rolling process for making discrete metal product.

Referring to FIG. 1, in operation, the production capacity of a first reversing plate mill 1 (RPM1) is substantially greater than that of a second reversing plate mill 2 (RPM2). In other words, the rate of production of rolled product on the first reversing plate mill 1 is greater than the rate of production of rolled product on the second reversing plate mill 2. The extra production capacity of the first reversing plate mill 1 can be utilized for production of thick discrete plates (mother plates), with thickness in the range of approximately 0.5 to 2.0 in., that do not require a use of the second reversing plate mill 2. Therefore the first reversing plate mill 1 can be rolling slabs for the production of mother plates for the production of discrete metal plate product (shown schematically as Rolling Process B in FIG. 1) while the second reversing plate mill 2 can be used for producing coiled metal product from transfer bars (shown schematically as Rolling Process A in FIG. 1).

Again, the preferred mill configuration is shown in FIG. 1. Other apparatus configurations within the scope of the invention are possible, for example equipment located upstream of the first reversing plate mill 1 and downstream the second reversing plate mill 2 may be added, removed or changed depending on the metal processing desired. At a minimum, in order to produce both discrete metal plate product and coiled metal product, at least one coiler 3 is located downstream from the second in-line reversing plate mill 2 and any equipment necessary to produce discrete metal plate product is located upstream the first reversing plate mill 1. The relative location and amount of additional equipment, like shear 4 and descaling box 5, are not important to achieving the production of discrete metal plates and coiled metal products.

In FIG. 1, roller table 6 is the transportation means leading to first reversing plate mill 1. Along roller table 6 is descaling box 5 followed by vertical edger 7, located proximate the entrance to first reversing plate mill 1. The first reversing plate mill 1 follows the vertical edger 7. Roller table 8 is located after the first reversing plate mill 1 in order to transport the transfer bar 9 produced to a shear 4, which is followed by the second reversing plate mill 2, which itself is proceeded by an entry side coiling furnace 10 and succeeded by an exit side coiling furnace 11. Another roller table 13 extends downstream from the second reversing plate mill 2 to the coiler 3.

In FIG. 1, the following additional equipment is added upstream of the reheat furnace 3 of the two-stand plate mill plant: a downcut shear 14, a roller table 15, a hot leveller 16, and a roller table 17. Roller table 6, roller table 8, roller table 13, roller table 15 and roller table 17 are all tables suitable for material transportation. They typically have a series of wheels or rollers on the transportation surface for passing products along the surface.

In the method of the present invention, coiled plates and thick discrete plates are produced in the following manner: Incoming slabs 18 are introduced to a reheat furnace 19, shown as a slab 18 inside reheat furnace 19, from a furnace charge table 20. Incoming slabs 18 are reheated and discharged, shown as slab 18*a*, onto roller table 6. Incoming slabs 18*a* move down roller table 6, through descaling box 5 and vertical edger 7 and are introduced to the first reversing plate mill 1. Rough passes for the incoming slabs 1 are performed by the first reversing plate mill 1. The effect of the rough passes is to roll incoming slab 18*a* from about 4 to 10 inches in thickness down to a bar size of approximately 0.75 to 1.5 in. thick.

The product of the first reversing plate mill 1 that is a bar approximately 0.75 to 1.5 in. thick is called a transfer bar 9. The transfer bar 9, discharged from first reversing plate mill 1, is passed onto roller table 8 where transfer bar 9 is cut by shear 4 and then rolled in the second reversing plate mill 2. The rolled product can then be wound in either entry side coiling furnace 10 or exit side coiling furnace 11 before it is rewound by coiler 3, a downcoiler.

As soon as the surrounding entrance area of the first reversing plate mill 1 becomes clear, the next slab 18 reheated in reheat furnace 19 and is discharged, shown as slab 18*a* in FIG. 1. This begins the processing of discrete metal product in the apparatus. Slab 18*a* is rolled on the first reversing plate mill 1 according to a schedule that produces a thickness in the range of approximately 0.5 to 2.0 in. Product that is rolled according to this schedule is called a mother plate 21. The mother plate 21 is transported upstream and divided by the downcut shear 14 into several daughter plates 22. Daughter plates 22 are flattened by the hot leveler 16 and chilled, if required, on the roller table 17. The flattened plates are then stacked (shown as stacked plates 22*a* in FIG. 1) for final cooling and subsequent transportation. Other typical plate finishing equipment, such as cooling beds, side trimmers, plate stackers, etc., can also be included upstream from the first reversing plate mill 1 in the finishing area.

In FIG. 1, Rolling Process A, represented by the line from roller table 6 to coiler 3, relates to conventional rolling of coiled plates that includes five steps:

(1) slab 18 reheating in reheat furnace 19

(2) roughing rolling of a slab in the first reversing plate mill 1 with simultaneous edging by the edger 7;

(3) rolling in the second reversing plate mill 2, for example a Steckel mill;

(4) cooling on the roller table 13; and (5) winding or coiling on the coiler 3.

Rolling Process B, represented by the line from roller table 6 to hot leveler 16, on the other hand, is an addition to the conventional rolling process that involves three steps:

(1) slab 18 reheating in the reheat furnace 19;

(2) roughing rolling of a mother plate 21 in the first reversing plate mill 1 with simultaneous edging by the edger 7; and (3) processing through shear 14, hot leveler 15 and roller table 17 to produce discrete plate product.

To show the advantage of the method and apparatus of the present invention, calculations were performed to simulate the operation of the process line of FIG. 1, including Rolling Process A and Rolling Process B. The data created allows for the comparison of the rolling time of the first reversing plate mill 1 with the rolling time of the second reversing plate mill 2. A comparison of the rolling times shows that the present method and apparatus is more efficient that those of the prior art.

Table 1 below is a table of three different potential rolling schedules, A1, A2 and A3, for steel processed in Rolling Process A of FIG. 1. Rolling schedules A1, A2, and A3 produce transfer bars in first reversing plate mill 1 (RPM1) with a thickness in the range of 0.986 in. to 1.99 in. The transfer bars then enter second reversing plate mill 2 (RPM2) and rolling schedules A1, A2 and A3 are completed finally producing product about 0.25 in thick, suitable for winding in a coiler.

TABLE 1

| Rev. | Sched. A1 | | Sched. A2 | | Sched. A3 | |
|---|---|---|---|---|---|---|
| Plate Mill | Pass No. | Exit Thickn. in. | Pass No. | Exit Thickn. in. | Pass No. | Exit Thickn. in. |
| RPM1 | | 8.1 | | 8.6 | | 6.20 |
| | 1 | 7.22 | 1 | 7.58 | 1 | 5.05 |
| | 2 | 6.24 | 2 | 6.50 | 2 | 3.846 |
| | 3 | 5.22 | 3 | 5.42 | 3 | 2.635 |
| | 4 | 4.22 | 4 | 4.35 | 4 | 1.62 |
| | 5 | 3.27 | 5 | 3.31 | 5 | 1.013 |
| | 6 | 2.53 | 6 | 2.32 | 6 | |
| | 7 | 1.99 | 7 | 1.80 | 7 | |
| | 8 | | 8 | 1.34 | 8 | |
| | 9 | | 9 | 0.986 | 9 | |
| RPM2 | | 1.99 | | 0.986 | | 1.013 |
| | 1 | 1.466 | 1 | 0.723 | 1 | 0.680 |
| | 2 | 1.068 | 2 | 0.552 | 2 | 0.453 |
| | 3 | 0.792 | 3 | 0.441 | 3 | 0.353 |
| | 4 | 0.577 | 4 | 0.371 | 4 | 0.293 |

TABLE 1-continued

| Rev. | Sched. A1 | | Sched. A2 | | Sched. A3 | |
|---|---|---|---|---|---|---|
| Plate Mill | Pass No. | Exit Thickn. in. | Pass No. | Exit Thickn. in. | Pass No. | Exit Thickn. in. |
| | 5 | 0.431 | 5 | 0.321 | 5 | 0.250 |
| | 6 | 0.346 | 6 | 0.280 | 6 | |
| | 7 | 0.296 | 7 | 0.250 | 7 | |
| | 8 | 0.263 | | | 8 | |
| | 9 | 0.250 | | | 9 | |

Table 2 below is a table of three different potential rolling schedules, B1, B2 and B3, for steel processed by Rolling Process B of FIG. 1. Rolling schedules B1, B2, and B3 produce mother plates in RPM1 having a thickness in the range of 0.5 in. to 2.0 in. Rolling schedules B1, B2 and B3 in the first reversing plate mill 1 are typically different than rolling schedules A1, A2 and A3 in the first reversing plate mill 1.

TABLE 2

| Rev. | Sched. B1 | | Sched. B2 | | Sched. B3 | |
|---|---|---|---|---|---|---|
| Plate Mill | Pass No. | Exit Thickn. in. | Pass No. | Exit Thickn. in. | Pass No. | Exit Thickn. in. |
| RPM1 | | 8.5 | | 8.5 | | 6.80 |
| | 1 | 7.45 | 1 | 7.43 | 1 | 6.00 |
| | 2 | 6.4 | 2 | 6.38 | 2 | 5.25 |
| | 3 | 5.35 | 3 | 5.37 | 3 | 4.50 |
| | 4 | 4.37 | 4 | 4.40 | 4 | 3.80 |
| | 5 | 3.47 | 5 | 3.52 | 5 | 3.13 |
| | 6 | 2.66 | 8 | 2.75 | 5 | 2.55 |
| | 7 | 2.0 | 7 | 21.2 | 7 | 2.07 |
| | 8 | 1.48 | 8 | 1.67 | 8 | 2.00 |
| | 9 | 1.1 | 9 | 1.36 | 9 | |
| | 10 | 0.85 | 10 | 1.15 | 10 | |
| | 11 | 0.67 | 11 | 1.02 | 11 | |
| | 12 | 0.56 | 12 | 1.0 | 12 | |
| | 13 | 0.51 | 13 | | 13 | |
| | 14 | 0.5 | 14 | | 14 | |
| | 15 | | 15 | | 15 | |

Table 3 shows possible rolling times that can be achieved for each rolling schedule of Table 1 and Table 2, if specific entry and exit gauges are used with certain grades of steel. Material grades 1, 2 and 3 correspond to low, medium and high grades of steel in this example.

using rolling schedule A2 and B2. Rolling sequence 3 includes rolling of one coiled one thick discrete plate by using rolling schedule A3 and B3.

In Table 3, for example, the total rolling time in rolling sequence 1 for the second reversing plate mill 2 producing product by rolling schedule A is 522.2 seconds. In comparison, the total rolling time for the first reversing plate mill 1 for producing transfer bars for both discrete metal products (rolling schedule B) and coiled metal products (rolling schedule B) in rolling sequence 1 is only 389.8 seconds. The last two columns of Table 3 list the total rolling times for the three rolling sequences.

Figure 2:
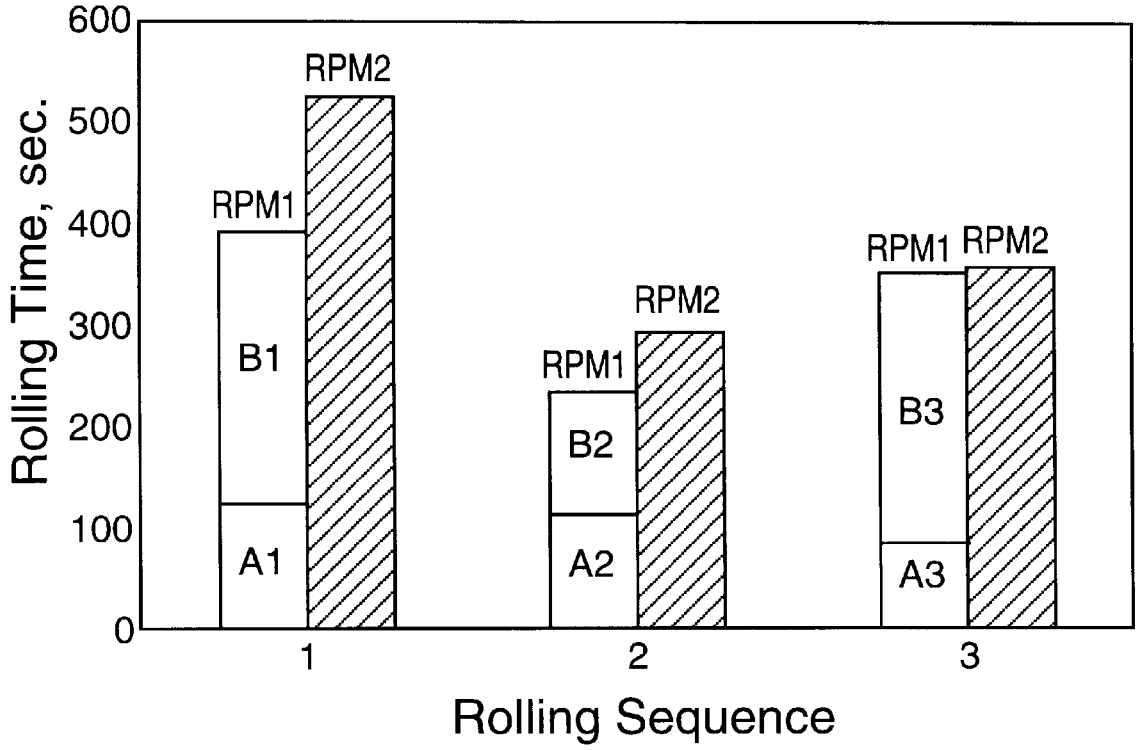
FIG. 2 is a graph showing the relative lengths of time of the operation of the first reversing plate mill for the completion of both rolling sequence A and rolling sequence B as compared to the time of operation of the second reversing plate mill for the completion of rolling sequence A.

FIG. 2 is a graph of the total rolling times listed in Table 3. FIG. 2 shows that the first reversing plate mill 1 can roll two incoming slabs 18, for Rolling Process A and the other for Rolling Process B, in less than the time it takes to produce coiled product by rolling a transfer bar in the second reversing plate mill 2.

FIG. 2 shows the preferred situation when, after adding the Rolling Process B, the overall production rate of the entire mill (RPM1+RPM2) was not reduced. This is only possible when the total time for roughing rolling of one transfer bar with the Rolling Process A and mother plate with the Rolling Process B is less than the time for rolling of one coil on the second reversing plate mill (the finishing mill) with the Rolling Process A. However, the present production process can also be justified when the total time for roughing rolling of one transfer bar with the Rolling Process A and one mother plate with the Rolling Process B is less than the time for rolling of one coil on the finishing mill with the Rolling Process A. This is true as long as the overall targets in respect to production of required products are achieved.

Again, RPM2 time is the time to roll one coil according to rolling process A (Table 1: rolling schedules A1–A3 for RPM2). FIG. 2 shows that during that time it is possible to roll on the roughing mill, RPM1, one transfer bar according to process A (Table 1: rolling schedules A1–A3 for RPM1) plus one mother plate according to process B (Table 2: rolling schedules B1–B3 for RPM1).

In Table 3, rolling time for two slabs in RPM1 is less than rolling time for one coil in RPM2. Thus, RPM1 is not a "bottle neck" for producing coil plates and can produce the mother plates in addition to rolling the transfer bars needed for rolling coil plates.

Thus the method and apparatus of the present invention can efficiently produce discrete metal plate products and coiled metal plate products.

TABLE 3

| Rolling Sequence | Plate Form | Sched. No. | Material Grade | Slab Width in. | Slab Length ft. | Slab Weight tons | Entry Gauge in. | Exit Gauge in. | Plate Length ft. | RPM1 Rolling time, sec. For each slab | RPM1 Rolling time, sec. For two slabs | Rolling time RPM2 sec. |
|---|---|---|---|---|---|---|---|---|---|---|---|---|
| 1 | coiled | A1 | 1 | 100.0 | 22.0 | 30.32 | 8.10 | 0.25 | 707.9 | 125.2 | | 522.2 |
| | discrete | B1 | 1 | 100.0 | 12.0 | 17.36 | 5.50 | 0.50 | 202.6 | 264.6 | 369.8 | |
| 2 | coiled | A2 | 2 | 86.0 | 11.0 | 13.84 | 8.60 | 0.25 | 375.0 | 112.4 | | 287.6 |
| | discrete | B2 | 1 | 100.0 | 24.0 | 13.17 | 6.80 | 2.00 | 202.7 | 120.4 | 232.8 | |
| 3 | coiled | A3 | 3 | 52.0 | 24.0 | 13.17 | 6.20 | 0.25 | 587.1 | 94.0 | | 351.1 |
| | discrete | B3 | 1 | 100.0 | 24.0 | 13.84 | 8.50 | 1.00 | 81.3 | 253.8 | 347.8 | |

Rolling schedules A1, A2 and A3 include rolling in both the first reversing plate mill 1 and the second reversing plate mill 2. Rolling schedules B1, B2 and B3 include rolling in only the first reversing plate mill 1. Rolling sequence 1 includes rolling of one coiled and one thick discrete plate by using the rolling schedule A1 and B1. Rolling sequence 2 includes rolling of one coiled one thick discrete plate by While there has been illustrated and described several embodiments of the present invention, it will be apparent that various changes and modifications thereof will occur to those skilled in the art. It is intended in the appended claims to cover all such changes and modifications that fall within the true spirit and scope of the present invention.

What is claimed is:

1. A method for producing discrete metal product and coiled metal product, comprising:

(a) rolling a first metal slab in a first in-line reversing plate mill according to a first rolling schedule, to produce a transfer bar;

directing said transfer bar downstream to a second in-line reversing plate mill;

rolling said transfer bar in said second in-line reversing plate mill creating a rolled product to produce said coiled metal product;

coiling said rolled product downstream from said second in-line reversing plate mill;

(b) while rolling said transfer bar in said second in-line reversing plate mill, rolling a second metal slab in said first in-line reversing plate mill according to a second rolling schedule, different from said first rolling schedule, to produce a mother plate;

directing said mother plate upstream from said first in-line reversing plate mill; and finishing said mother plate upstream from said first in-line reversing plate mill to produce said discrete metal product.

2. The method for producing discrete metal product and coiled metal product according to claim 1 further comprising the step of shearing said transfer bar prior to rolling said transfer bar in the second in-line reversing plate mill.

3. The method for producing discrete metal product and coiled metal product according to claim 1 further comprising the steps of coiling the rolled product of the second in-line reversing plate mill in at least the entrance side coiling furnace or the exit side coiling furnace to form coiled product followed by uncoiling said coiled product and recoiling the uncoiled product on a downcoiler downstream from said coiling furnace.

4. The method for producing discrete metal product and coiled metal product according to claim 1 further comprising the step of shearing said mother plate into daughter plates after directing said mother plate upstream from said first in-line reversing plate mill.

5. The method for producing discrete metal product and coiled metal product according to claim 1, wherein said first rolling schedule rolls product to a thickness in the range of about 0.75 to 1.5 inches.

6. The method for producing discrete metal product and coiled metal product according to claim 1, wherein said second rolling schedule rolls product to a thickness in the range of about 0.5 to 2.0 inches.

7. The method for producing discrete metal product and coiled metal product according to claim 1, wherein said rolling in said second rolling mill produced rolled product about 0.25 inches thick.

8. The method for producing discrete metal product and coiled metal product according to claim 4 further comprising the steps of finishing said daughter plates.

9. An in-line apparatus for producing discrete metal product and coiled metal product, comprising:

a first in-line reversing plate mill;

a second in-line reversing plate mill downstream from said first in-line reversing plate mill;

at least one coiler downstream from said second in-line reversing plate mill; and at least one finishing apparatus upstream from said first in-line reversing plate mill.

10. The in-line apparatus for producing discrete metal product and coiled metal product according to claim 9 further including a reheat furnace between said first in-line reversing plate mill and said at least one finishing apparatus upstream from said first in-line reversing plate mill.

11. The in-line apparatus for producing discrete metal product and coiled metal product according to claim 9 further including a shear apparatus disposed between said first in-line reversing plate mill and said second in-line reversing plate mill.

12. The in-line apparatus for producing discrete metal product and coiled metal product according to claim 9 further including a roller table between said first in-line reversing plate mill and said second in-line reversing plate mill and between said first in-line reversing plate mill and said at least one finishing apparatus.

13. The apparatus for producing discrete metal product and coiled metal product according to claim 9 wherein said finishing apparatus is one or more members selected from the group consisting of: a downcut shear, an edger and a hot leveler.

14. The apparatus for producing discrete metal product and coiled metal product according to claim 9 further including an edger prior to said first reversing plate mill.

* * * * *